US012735858B2

(12) United States Patent
Richards et al.

(10) Patent No.: US 12,735,858 B2
(45) Date of Patent: Sep. 15, 2026

(54) WORK TOOL FLOAT MANAGEMENT

(71) Applicant: Caterpillar Inc., Peoria, IL (US)

(72) Inventors: Travis N. Richards, Chillicothe, IL (US); Brad R. Van De Veer, Washington, IL (US); Jeffrey L. Kuehn, Germantown Hills, IL (US); Michael S. Hill, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 539 days.

(21) Appl. No.: 18/357,538

(22) Filed: Jul. 24, 2023

(65) Prior Publication Data

US 2025/0034836 A1 Jan. 30, 2025

(51) Int. Cl.
*E02F 3/84* (2006.01)

(52) U.S. Cl.
CPC ..... *E02F 3/844* (2013.01)

(58) Field of Classification Search
CPC ..... E02F 3/844
See application file for complete search history.

(56) References Cited

U.S. PATENT DOCUMENTS

| | | | | |
|---|---|---|---|---|
| 4,852,660 | A * | 8/1989 | Leidinger et al. | E02F 3/7654 |
| 8,762,010 | B2 | 6/2014 | Farmer et al. | |
| 9,506,224 | B2 | 11/2016 | Kontz | |
| 9,896,820 | B2 | 2/2018 | Faivre et al. | |
| 10,450,722 | B2 | 10/2019 | Moriki et al. | |
| 2019/0382983 | A1 * | 12/2019 | Gentle et al. | E02F 9/2025 |
| 2022/0127821 | A1 | 4/2022 | Kuehn et al. | |

FOREIGN PATENT DOCUMENTS

| | | | |
|---|---|---|---|
| CN | 102330442 | B | 6/2013 |
| JP | 2010-2705525 | A | 12/2010 |

* cited by examiner

*Primary Examiner* — Brodie J Follman

(57) ABSTRACT

A mobile construction equipment for operation on a surface includes: a work tool that is movable between at least one float position, in which the work tool floats with respect to the surface, and at least one non-float position, in which the work tool does not float with respect to the surface; a machine speed sensor for providing a machine speed of the mobile construction equipment; and a controller having a work tool float mode, in which the work tool is movable to the at least one float position, the controller, in a work tool float inhibit mode, in which the work tool is not movable to the at least one float position, receiving the machine speed, and, if the machine speed exceeds a float activation limit: disabling the work tool float mode so as to prevent the work tool from moving to the at least one float position.

15 Claims, 8 Drawing Sheets

WORK TOOL FLOAT MANAGEMENT

FIELD

The present disclosure generally relates to mobile construction equipment, such as a motor grader, and more particularly to methods and controllers for managing the ability of a surface-engaging work tool of the mobile construction equipment, such as a blade of a motor grader, to float with respect to the surface on which the mobile construction equipment is operating.

BACKGROUND

Mobile construction equipment can be used for road work, ditch work, site preparation, and other surface contouring and finishing tasks. The versatility of mobile construction equipment is provided in large part by the ability to mount one or more surface-engaging work tools to the mobile construction equipment.

FIGS. 1-2 are a schematic views of a conventional motor grader 10, which is one example of a mobile construction equipment. Other mobile construction equipment can include, for example, excavators, loaders, trucks, pavers, planers, compactors, shovels, material handlers, etc., each of which can have one or more surface-engaging work tools. For simplicity, the present application discusses motor grader 10 as one example of mobile construction equipment. However, the discussion herein is equally applicable to all other types of mobile construction equipment that include one or more surface-engaging work tools.

As shown, motor grader 10 includes a front frame 12 and rear frame 14. Rear frame 14 includes a power source, contained within a rear compartment 20, that is operatively coupled through a transmission to rear traction devices or wheels 22 for primary machine propulsion. The power source may be, for example, a diesel engine, a gasoline engine, a natural gas engine, or any other engine. The power source may also be an electric motor linked to a fuel cell, capacitive storage device, battery, or another source of power. Rear wheels 22 are operatively supported on tandem axles 24, which are pivotally connected to motor grader 10 between rear wheels 22 on each side of motor grader 10. The transmission may be a mechanical transmission, hydraulic transmission, or any other transmission type. The transmission may be operable to produce multiple output speed ratios (or a continuously variable speed ratio) between the power source and driven traction devices.

Motor grader 10 includes an articulation joint 62 that pivotally connects front frame 12 and rear frame 14. Both a left articulation actuator 64 and right articulation actuator 66 are connected between front frame 12 and rear frame 14 on opposing sides of motor grader 10, as shown in FIG. 2. Left and right articulation actuators 64, 66 are used to pivot front frame 12 relative to rear frame 14 about an articulation axis B.

Front frame 12 typically supports an operator station 26 that contains operator controls, along with a variety of displays or indicators, such as user interface 27, for conveying information to the operator for primary operation of motor grader 10, or receiving input from the operator. For example, motor grader 10 may include a machine speed sensor 90, which could be any sensor configured to monitor machine speed V, including sensors associated with any of the front wheels 58, 60, rear wheels 22, axle shafts, motors, or other components of the drivetrain of motor grader 10. Machine speed V could be displayed on user interface 27.

Operator station 26 may also include one or more steering controls 106 (e.g., for steering front wheels 58, 60). Steering controls 106 may be, for example, a steering wheel 106 or any other type of operator input device, such as a dial, joystick, keyboard, pedal, or other devices. Operator station 26 also includes one or more articulation controls 116 (e.g., for controlling left and right articulation actuators 64, 66). Articulation controls 116 could also be any type of operator input device, such as a dial, joystick, keyboard, pedal, or other device.

Beam 28 of front frame 12 may support a surface-engaging work tool, such as main blade assembly 16, which moves blade 30 thereof to a wide range of positions relative to motor grader 10 and surface 86. Blade 30 is but one example of a surface-engaging work tool. Other surface-engaging work tools can include a front blade assembly with its own blade, rippers, snow wings, scarifiers, buckets, etc., and the discussion herein of blade 30 is equally applicable to all other types of surface-engaging work tools.

Main blade assembly 16 includes a drawbar 32 pivotally mounted to a first end 34 of beam 28 via a ball joint or the like. The position of drawbar 32 is typically controlled by hydraulic cylinders: right lift cylinder 36 and left lift cylinder 38, as shown in FIG. 2, that control vertical movement, and a center shift cylinder 40, as shown in FIG. 1, that controls horizontal movement. Right and left lift cylinders 36, 38 are connected to a coupling 70 that includes lift arms 72 pivotally connected to beam 28 for rotation about rotation axis C. A bottom portion of coupling 70 may have an adjustable length horizontal member 74 that is connected to center shift cylinder 40. Although the present application discusses mobile construction equipment in the context of motor grader 10, which has two lift cylinders (i.e., right lift cylinder 36 and left lift cylinder 38), it is possible that the mobile construction equipment has only a single lift cylinder for the surface-engaging work tool or more than two lift cylinders for the surface-engaging work tool. Furthermore, each lift cylinder can be controlled (e.g., floated, as discussed in more detail below) independently of any other lift cylinder.

Drawbar 32 may include a large, flat plate, commonly referred to as a yoke plate 42. Beneath yoke plate 42 is a circular gear arrangement and mount, commonly referred to as a circle 44. Circle 44 is rotated by, for example, a hydraulic motor known as a circle drive 46. Rotation of circle 44 by circle drive 46 rotates attached blade 30 about a circle axis A perpendicular to a plane of yoke plate 42.

Blade 30 is also mounted to circle 44 via a pivot assembly 50 that allows for tilting of blade 30 relative to circle 44. A blade tip cylinder 52 is used to tilt blade 30 forward or rearward. In other words, blade tip cylinder 52 is used to tip or tilt a top edge 54 of blade 30 relative to a bottom cutting edge 56 of blade 30, which is commonly referred to as blade tip. Blade 30 is also mounted to a sliding joint associated with circle 44 that allows blade 30 to slide or shift from side-to-side relative to circle 44. The side-to-side shift is commonly referred to as blade side shift. A side shift cylinder or the like is used to control the blade side shift.

The foregoing components allow for movement of blade 30 in a number of different manners. To determine a position of blade 30, motor grader 10 can include, for example, mainfall sensor 136, rotation sensor 138, and blade slope sensor 140, as shown in FIG. 3. These sensors may be used to measure the mainfall or pitch of motor grader 10, the blade slope of blade 30, and the circle rotation angle of circle 44, respectively. Other types of surface-engaging work tools may have the same or other sensors associated therewith in order to determine the position of the surface-engaging work tool.

Mainfall sensor 136 may be a single multi-axis inertial measurement unit ("IMU") configured to produce a signal indicative of the longitudinal pitch of motor grader 10 and a signal indicative of the lateral roll of motor grader 10. IMUs are self-contained sensor systems capable of generating signals indicative of linear and angular motion. A multi-axis IMU includes two or more gyroscopes and accelerometers for measuring linear and angular motion in at least two dimensions (e.g., along two axes). The axes of the multi-axis IMU are typically aligned with the longitudinal axis of motor grader 10 and the lateral axis of motor grader 10 to generate signals indicative of the longitudinal pitch and lateral roll of motor grader 10, respectively.

Rotation sensor 138 may be configured to produce a signal indicative of the angle of blade 30 relative to front frame 12 and the lateral axis of motor grader 10. Rotation sensor 138 produces a signal indicative of the direction of blade 30 relative to the direction of travel of motor grader 10.

Blade slope sensor 140 may be configured to produce a signal indicative of the lateral slope of blade 30. The axis of mainfall sensor 136 is aligned with the longitudinal axis of motor grader 10 to generate signals indicative of the longitudinal pitch of motor grader 10, while blade slope sensor 140 generates signals indicative of the lateral roll of motor grader 10 when blade 30 is aligned with a lateral axis of motor grader 10.

Rotation sensor 138 can be used in conjunction with blade slope sensor 140 to determine the lateral roll of motor grader 10 when blade 30 is aligned with the lateral axis of motor grader 10, ensuring that signals from blade slope sensor 140 are measuring the slope of a surface that is perpendicular to the direction of travel of motor grader 10.

FIG. 4 shows a block diagram of a control system 94 for main blade assembly 16 and blade 30 of motor grader 10. Control system 94 generally includes a controller, or electronic control module. 96 configured to receive a plurality of instructions from various sensors and/or operator commands, and to responsively provide instructions to control various actuators of motor grader 10 and/or communicate with the operator of motor grader 10. Controller 96 may include various components for executing software instructions designed to regulate various subsystems of motor grader 10. For example, controller 96 may include a central processing unit (CPU), a random access memory (RAM), a read-only memory (ROM), input/output elements, etc. Controller 96 may execute machine readable instructions stored in controller 96 on a mass storage device. RAM, ROM, local memory, and/or on a removable storage medium, such as a CD, DVD, and/or flash memory device.

As shown, control system 94 may incorporate a number of inputs related to a position of a surface-engaging work tool, such as inputs from mainfall sensor 136, rotation sensor 138, blade slope sensor 140, machine speed sensor 90, and user interface 27, among others, in order to control an output related to the surface-engaging work tool, such as a position of blade 30 (e.g., by actuating one or more of right and left lift cylinder 36, 38, center shift cylinder 40, circle drive 46, blade tip cylinder 52, etc.).

Although FIG. 4 provides an example of control system 94 in the context of main blade assembly 16 and its blade 30, the discussion of control system 94 is nonetheless applicable to every surface-engaging work tool of a mobile construction equipment that is capable of being moved with respect to surface 86 and/or the mobile construction equipment to which the surface-engaging work tool is mounted. In particular, each surface-engaging work tool can have its own inputs (i.e., from sensors or controls similar to those shown in FIG. 4) related to the position of the surface-engaging work tool, which inputs are input into controller 96. Furthermore, each surface-engaging work tool can have its own outputs (i.e., to actuators associated with the surface-engaging work tool similar to those shown in FIG. 4) to control the position of the surface-engaging work tool with respect to surface 86 and/or the mobile construction equipment.

In certain situations, it is desirable for a surface-engaging work tool, such as blade 30, to "float" with respect to surface 86, as shown in FIG. 5A. When a surface-engaging work tool is in a float position $P_F$, it is free to move in the vertical direction Y, and whatever external forces act on the surface-engaging work tool in the vertical direction Y, namely the force due to gravity $F_G$ and the force due to surface 86 $F_{86}$, are what cause the surface-engaging work tool to move in the vertical direction Y. In this context, the forces acting on the surface-engaging work tool in the vertical direction Y due to gravity and surface 86 (i.e., $F_G$ and $F_{86}$) are equal and opposite, and therefore cancel. No other forces, such as forces imparted by one or more lift cylinders associated with the surface-engaging work tool (e.g., forces $F_{36}$, $F_{38}$ from right and left lift cylinders 36, 38, respectively, in the context of blade 30), act on the surface-engaging work tool in the vertical direction Y when it is floating.

Although FIG. 5A shows a single float position $P_F$, more than one absolute position of the surface-engaging work tool can be considered a float position $P_F$ given that surface 86 on which the mobile construction equipment is operating is imperfect and variable. In other words, in a practical sense, many different absolute positions of the surface-engaging work tool with respect to surface 86 and/or the mobile construction equipment can be viewed as a float position $P_F$, as long as each of those positions satisfies the criterion that there is no net force acting on the surface-engaging work tool in the vertical direction Y. Furthermore, simply because a surface-engaging work tool in a float position $P_F$ contacts an impediment on surface 86 that is sufficient to move the surface-engaging work tool from its float position $P_F$ does not mean the surface-engaging work tool is no longer floating, as the control system managing the surface-engaging work tool will immediately react to revert the surface-engaging work tool back to the float position $P_F$.

In a non-float position $P_{NF}$, as shown in FIG. 5B, there is a net force acting on the surface-engaging work tool in the vertical direction Y. For example, in addition to the force due to gravity $F_G$ and the force due to surface 86 $F_{86}$, the surface-engaging work tool in FIG. 5B is subject to forces from right lift cylinder 36 and left lift cylinder 38, namely forces $F_{36}$, $F_{38}$, respectively, which result in a net force on the surface-engaging work tool in the vertical direction Y. Since there is a net force acting on the surface-engaging work tool in the vertical direction Y, the surface-engaging work tool is no longer in float position $P_F$, but is instead in non-float position $P_{NF}$.

Although FIG. 5B shows a single non-float position $P_{NF}$, more than one absolute position of the surface-engaging work tool can be considered a non-float position $P_{NF}$ given the variability of forces that can act on the surface-engaging work tool. For example, there are many possible absolute positions of the surface-engaging work tool or situations in which there is some non-zero net force acting on the surface-engaging work tool in the vertical direction Y. As one example, the surface-engaging work tool is in a non-float position $P_{NF}$ whenever the operator of the mobile construction equipment is actively trying to raise or lower the surface-engaging work tool in the vertical direction Y.

When a surface-engaging work tool, such as blade 30, is floating with respect to surface 86 (i.e., as shown in FIG. 5A), and the mobile construction equipment to which the surface-engaging work tool is mounted is moving, contact between the surface-engaging work tool and an impediment on surface 86 (e.g., a large rock) may cause the mobile construction equipment to veer off course, for example, by pulling the surface-engaging work tool and the mobile construction equipment to which it is attached toward the impediment. A surface-engaging work tool can also sometimes be mistakenly instructed to float or be put in a float position $P_F$ (e.g., by an inexperienced operator) in inappropriate conditions. There is therefore a need to better manage the ability of a surface-engaging work tool to float with respect to the surface on which a mobile construction equipment is operating.

SUMMARY

One aspect of the present disclosure is directed to a mobile construction equipment for operation on a surface, the mobile construction equipment comprising: a work tool that is movable between at least one float position, in which the work tool floats with respect to the surface, and at least one non-float position, in which the work tool does not float with respect to the surface; a machine speed sensor configured to provide a machine speed of the mobile construction equipment; and a controller having a work tool float mode, in which the work tool is movable to the at least one float position, the controller being configured, in a work tool float inhibit mode, in which the work tool is not movable to the at least one float position, to receive the machine speed, and, if the machine speed exceeds a float activation limit, at least one of: disable the work tool float mode so as to prevent the work tool from moving to the at least one float position, or provide an indication to an operator of the mobile construction equipment that the machine speed exceeds the float activation limit.

Another aspect of the present disclosure is directed to a method for transitioning a work tool of a mobile construction equipment between at least one float position, in which the work tool floats with respect to a surface on which the mobile construction equipment is operating, and at least one non-float position, in which the work tool does not float with respect to the surface, the mobile construction equipment having a controller, the method comprising: in a work tool float inhibit mode of the controller, in which the work tool is not movable to the at least one float position, receiving, by the controller, a machine speed of the mobile construction equipment; and if the machine speed does not exceed a float activation limit, enabling, by the controller, a work tool float mode, in which the work tool is movable to the at least one float position; or if the machine speed exceeds the float activation limit, at least one of: disabling, by the controller, the work tool float mode so as to prevent the work tool from moving to the at least one float position, or providing an indication to an operator of the mobile construction equipment that the machine speed exceeds the float activation limit.

A further aspect of the present disclosure is directed to a controller for a mobile construction equipment having a work tool movable between at least one float position, in which the work tool floats with respect to the surface, and at least one non-float position, in which the work tool does not float with respect to the surface, the controller being configured to: in a work tool float inhibit mode of the controller, in which the work tool is not movable to the at least one float position, receive a machine speed of the mobile construction equipment; and if the machine speed does not exceed a float activation limit, enable a work tool float mode, in which the work tool is movable to the at least one float position; or if the machine speed exceeds the float activation limit, at least one of: disable the work tool float mode so as to prevent the work tool from moving to the at least one float position, or provide an indication to an operator of the mobile construction equipment that the machine speed exceeds the float activation limit.

DETAILED DESCRIPTION

The present application describes methods and controllers for managing the ability of a surface-engaging work tool of a mobile construction equipment to float with respect to a surface on which the mobile construction equipment is operating.

Although the present application focuses on moving blade 30 of main blade assembly 16 between at least one float position $P_F$ and at least one non-float position $P_{NF}$, the discussion herein is equally applicable to any and all other surface-engaging work tools beyond blade 30 of main blade assembly 16, including a front blade assembly with its own blade, rippers, snow wings, scarifiers, buckets, etc. Moreover, although the present application focuses on motor grader 10 as the mobile construction equipment, the discussion herein is equally applicable to any other mobile construction equipment to which a surface-engaging work tool can be mounted, including, for example, excavators, loaders, trucks, pavers, planers, compactors, shovels, material handlers, etc.

Figure 1:
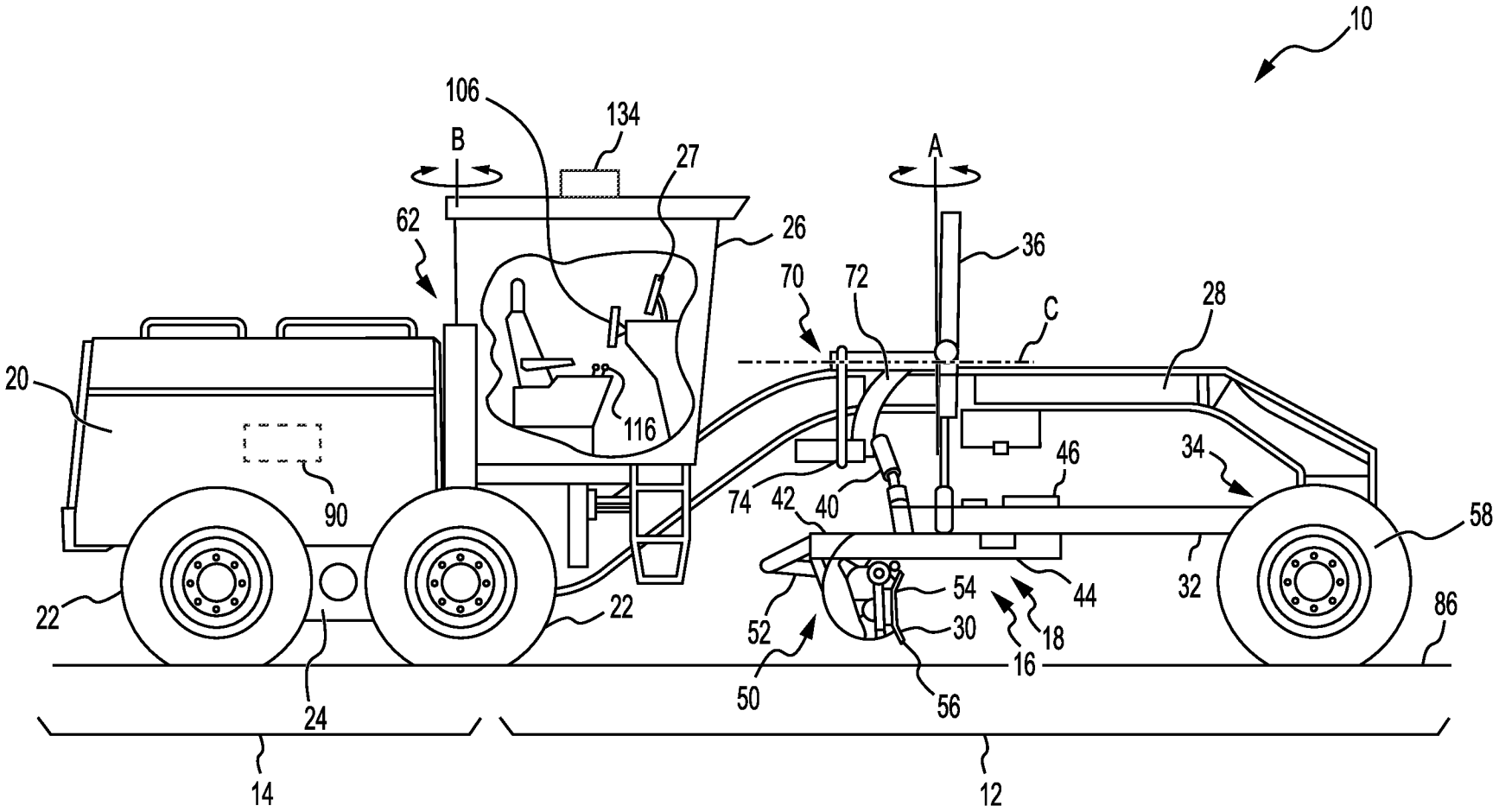
FIG. 1 PRIOR ART
FIG. 1 is a side view of a conventional motor grader, which is an example of a mobile construction equipment.
Figure 2:
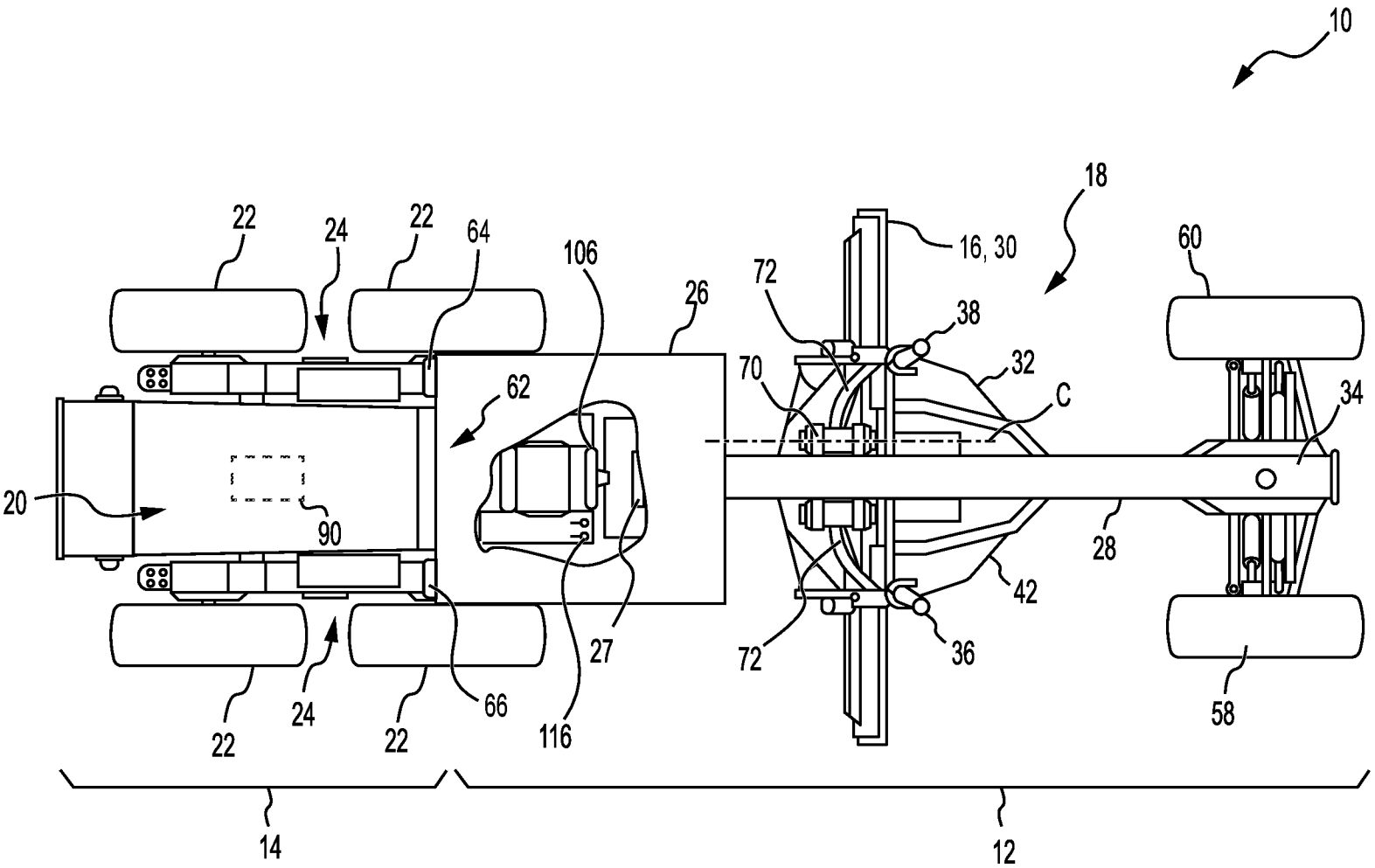
FIG. 2 PRIOR ART
FIG. 2 is a top view of the motor grader of FIG. 1.
Figure 3:
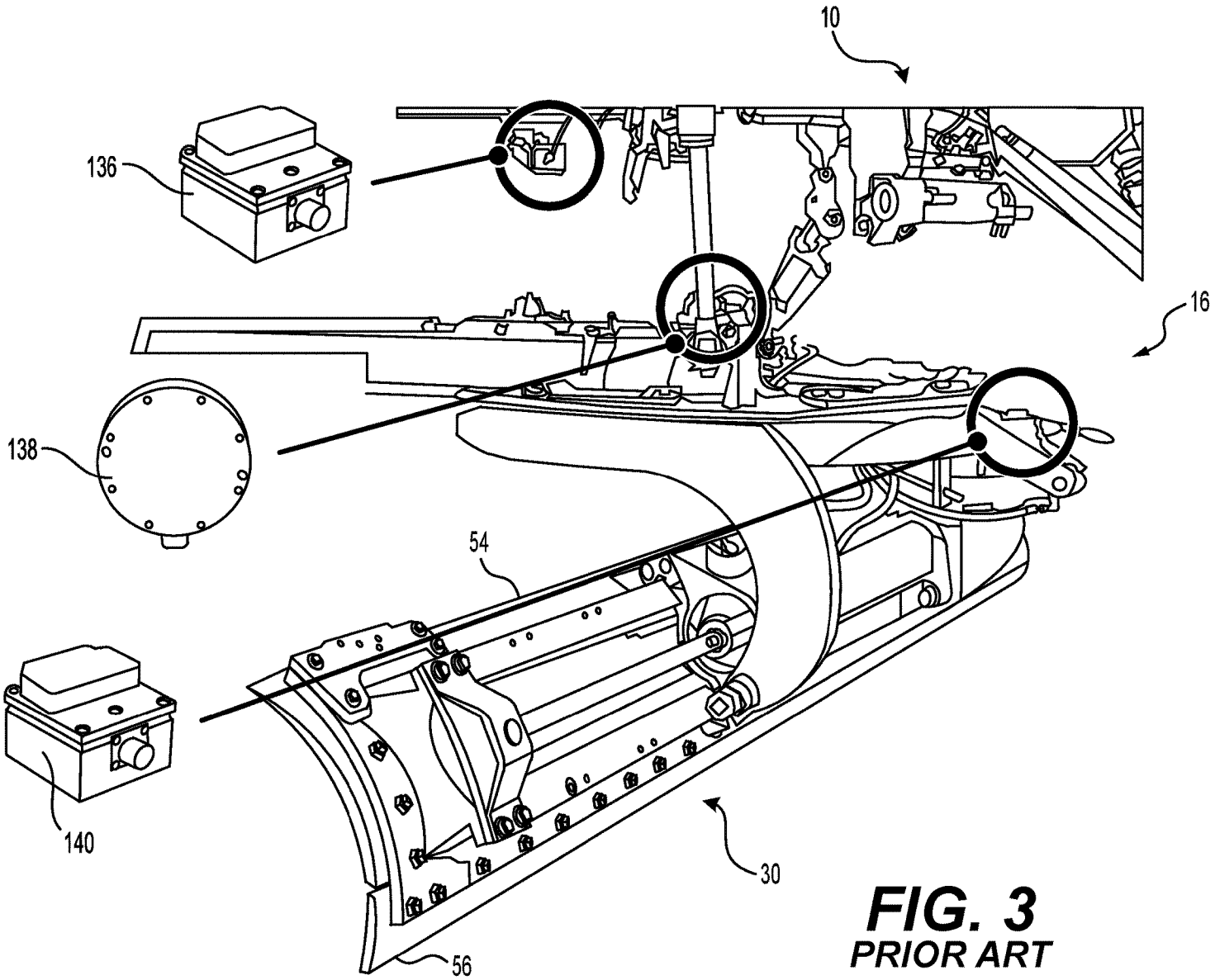
FIG. 3 PRIOR ART
FIG. 3 is a detail view showing a blade of the motor grader of FIGS. 1-2, which is an example of a surface-engaging work tool.
Figure 4:
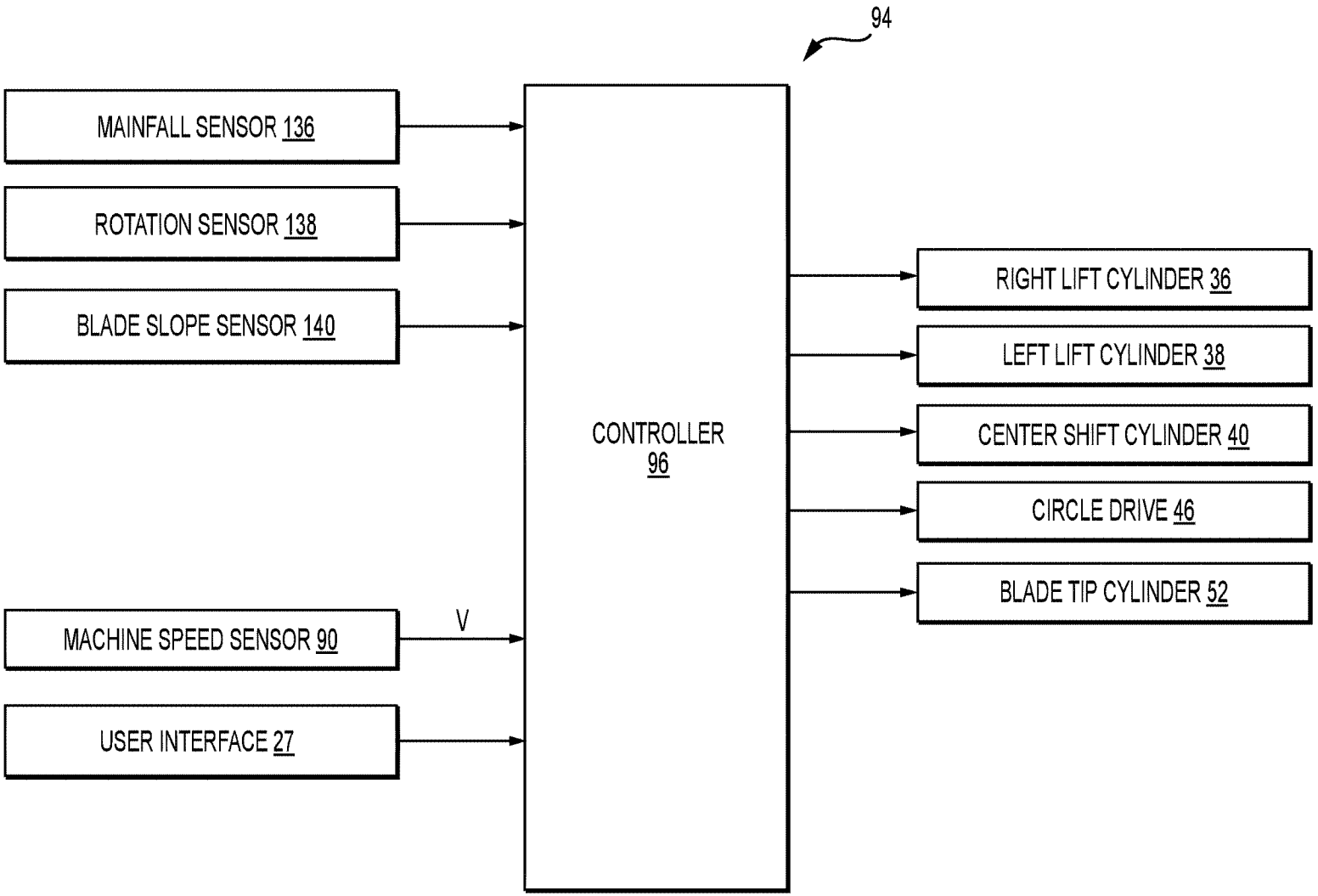
FIG. 4 PRIOR ART
FIG. 4 shows a conventional control system for the motor grader of FIGS. 1-3.
Figure 5B:
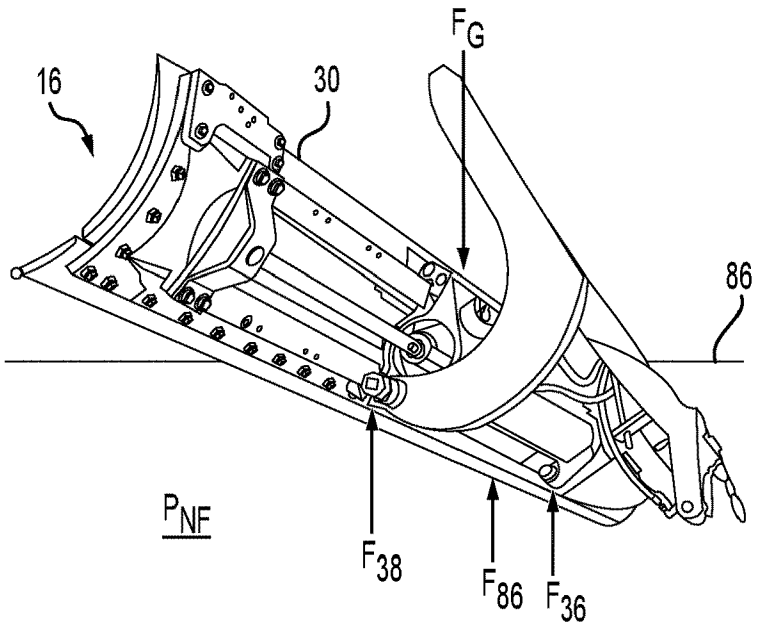
FIG. 5B PRIOR ART
FIGS. 5A-5B show the blade of FIG. 3 in a float position and a non-float position, respectively.
Figure 5A:
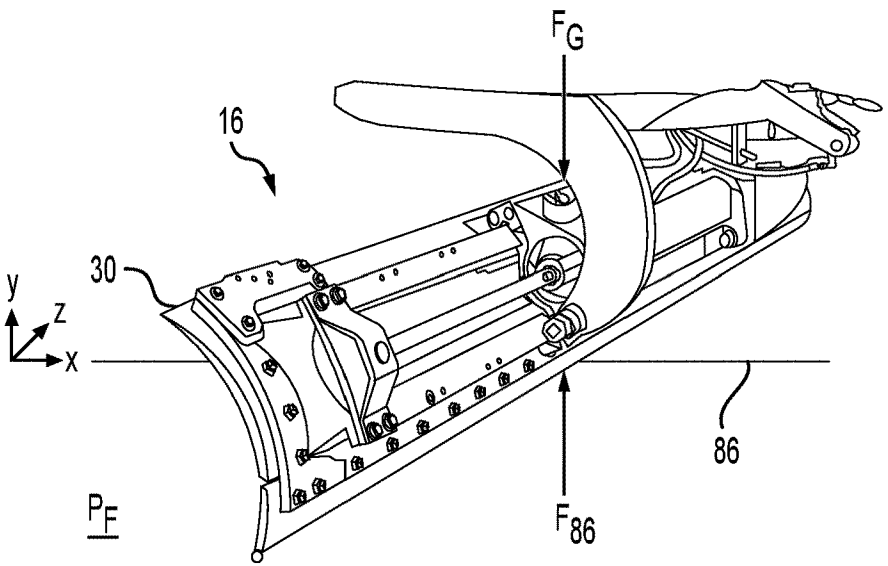
FIG. 5A PRIOR ART
Figure 6:
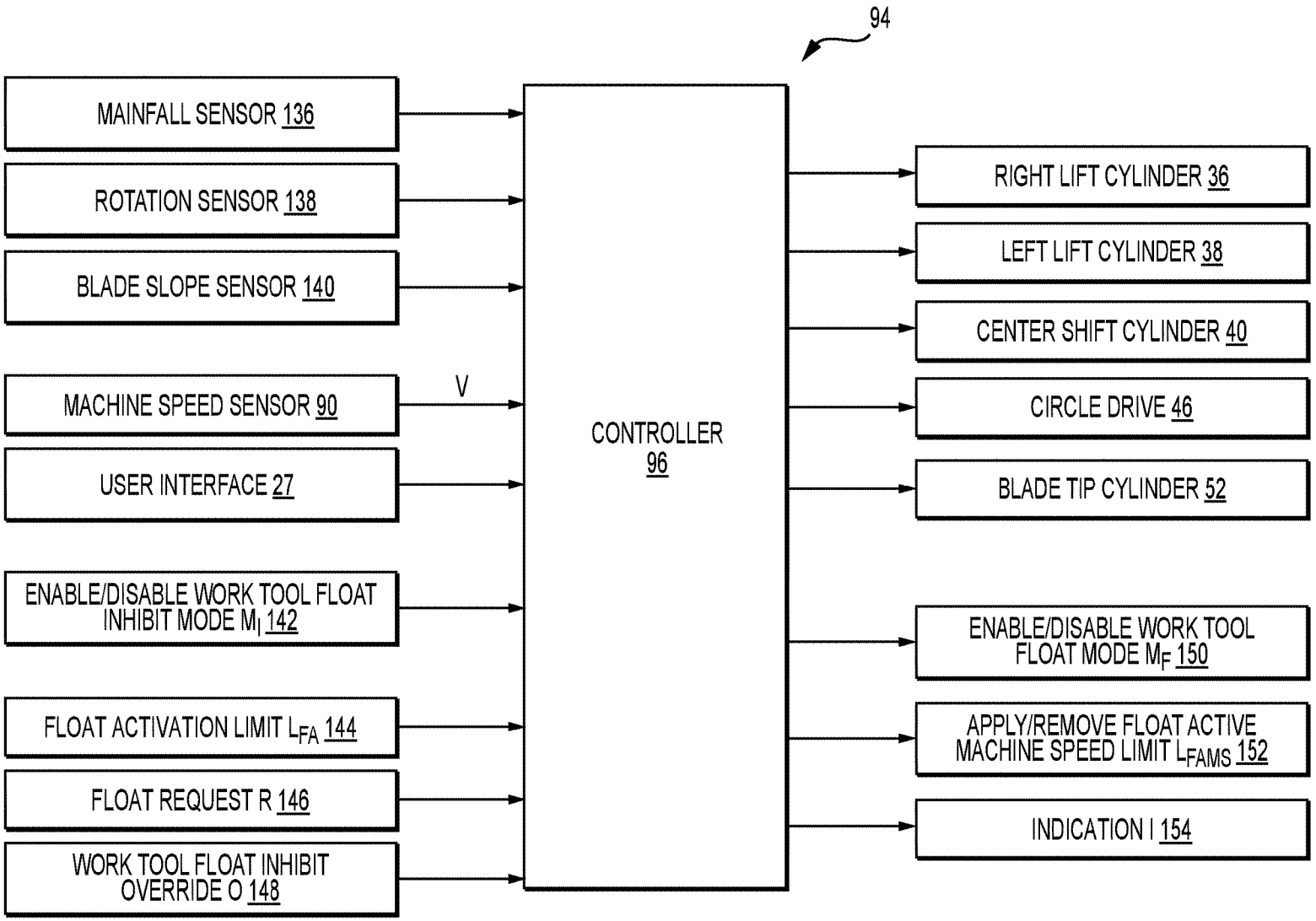
FIG. 6 shows a work tool float management control system for a mobile construction equipment according to the present disclosure.

FIG. 6 shows a work tool float management control system 94 for use with motor grader 10 of FIGS. 1-3 that is similar to control system 94 described in the context of FIG. 4, but incorporates different inputs and outputs and has different modes. Specifically, control system 94 of FIG. 6 includes, for example, an input 142 for enabling or disabling a work tool float inhibit mode $M_I$, an input 144 for inputting a float activation limit $L_{FA}$, an input 146 for inputting a float request R, and an input 148 for inputting a work tool float inhibit override O. On the output side, control system 94 includes an output 150 for enabling and disabling a work tool float mode $M_F$, an output 152 for applying or removing a float active machine speed limit $L_{FAMS}$ from motor grader 10, and an output 154 for providing an indication I to the operator of motor grader 10. These components are each discussed below in more detail in connection with the methods shown in FIGS. 7-8.

Figure 7:
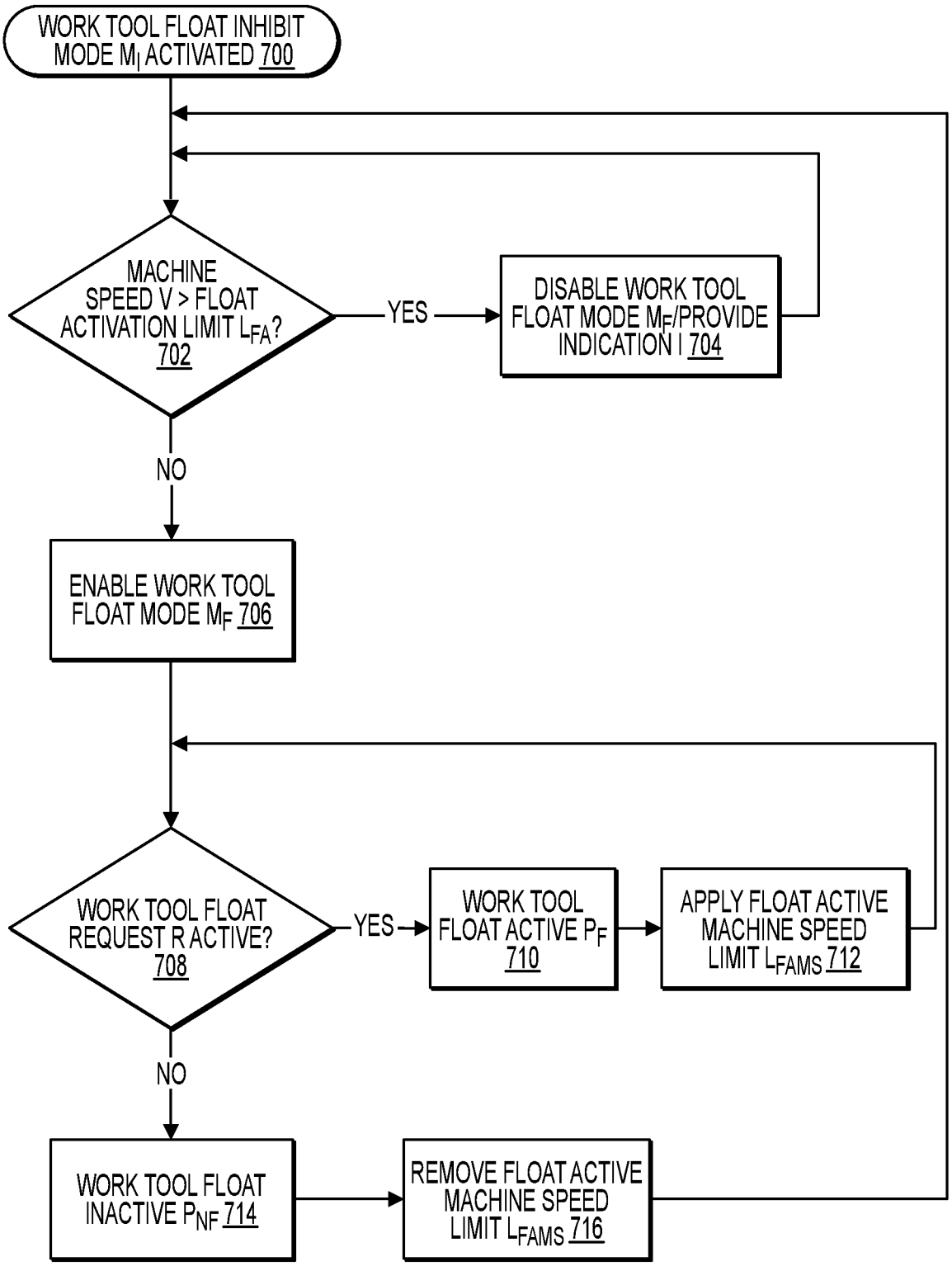
FIG. 7 shows a work tool float management method according to the present disclosure.

Turning to FIG. 7, initially, at step 700, control system 94 (i.e., via controller 96) determines, via input 142, whether work tool float inhibit mode $M_I$ is activated. When work tool float inhibit mode $M_I$ is activated, the controls and methods of the present application are initiated in order to limit the ability of blade 30 to be put into float position $P_F$ and/or limit machine speed V. When work tool float inhibit mode $M_I$ is not activated, the controls and methods of the present application are not initiated in order to limit the ability of blade 30 to be put into float position $P_F$ and/or limit machine speed V.

If work tool float inhibit mode $M_I$ is activated, the method proceeds to step 702, wherein controller 96 compares machine speed V to float activation limit $L_{FA}$. Machine speed V is inputted to controller 96 by machine speed sensor 90, while float activation limit $L_{FA}$ may be input to controller 96 at input 144. Float activation limit $L_{FA}$ is a machine speed above which it is unsafe to place blade 30 into float position $P_F$, For example, above a certain machine speed, such as fifteen miles per hour, it may be deemed unsafe to put blade 30 into float position $P_F$, as doing so may increase the likelihood of a negative consequence with respect to motor grader 10 if blade 30 contacts an impediment while in float position $P_F$, Float activation limit $L_{FA}$ may be adjustable (e.g., by the operator of motor grader 10).

If machine speed V is greater than float activation limit $L_{FA}$, the method proceeds to step 704, in which work tool float mode $M_F$ is disabled (i.e., via output 150) and/or controller 96 provides an indication I to the operator of motor grader 10 (i.e., output 154). When work tool float mode $M_F$ is disabled, blade can no longer be moved to float position $P_F$. Such a situation is desirable if, as discussed previously, machine speed V is too high for blade 30 to float safely. Either alternatively or in addition to disabling work tool float mode $M_F$, controller 96 can also in step 704 provide indication I, which may be, for example, a visual or audio warning that machine speed V is too high to safely operate blade 30 in float position Pr. In response to indication I, the operator of motor grader 10 can then manually lower machine speed V below float activation limit $L_{FA}$ if it is still desired to place blade 30 into float position $P_F$.

If machine speed V is not greater than float activation limit $L_{FA}$, the method proceeds to step 706, in which work tool float mode $M_F$ is enabled (i.e., via output 150). When work tool float mode $M_F$ is enabled, blade 30 is movable to float position $P_F$. In other words, the method determines that machine speed V is low enough such that placing blade 30 into float position $P_F$ will not present an undue risk to the operator of motor grader 10 or to motor grader 10 itself.

Once controller 96 is placed into work tool float mode $M_F$, controller 96 then determines, at step 708, whether it has received a float request R (via input 146). A float request R is a request that blade 30 be placed into float position $P_F$, If controller 96 determines that float request R has been received, at step 710 controller 96 places blade 30 into float position $P_F$, Blade 30 being in float position $P_F$ is equivalent to the float being "active," as shown in FIG. 7.

Furthermore, if the float is active, in step 712 controller 96 applies float active machine speed limit $L_{FAMS}$ (via output 152) so as to limit machine speed V to float active machine speed limit $L_{FAMS}$ while blade 30 is in float position $P_F$. In particular, float active machine speed limit $L_{FAMS}$ is a maximum permissible machine speed V at which motor grader 10 can be operated while blade 30 is in float position $P_F$. Float active machine speed limit $L_{FAMS}$ may be adjustable (e.g., by the operator of motor grader 10), and may be the same quantity or a different quantity than float activation limit $L_{FA}$. For example, float active machine speed limit $L_{FAMS}$ and float activation limit $L_{FA}$ may need to be set at different values to avoid a sudden change in machine motion if the operator of motor grader 10 wishes to accelerate motor grader 10 while putting blade 30 into float position $P_F$. Moreover, in a conventional transmission machine, float active machine speed limit $L_{FAMS}$ could be set at a value to prevent shifting the transmission into a higher gear so at to prevent motor grader 10 from attaining a higher machine speed V.

After applying float active machine speed limit $L_{FAMS}$, controller 96 continues to evaluate, at step 708, whether float request R continues to be received. If float request R continues to be received, it is indicative of the operator of motor grader 10 wanting to keep blade 30 in float position $P_F$, However, if float request R is no longer received, then the operator of motor grader 10 wants blade 30 to be moved from float position $P_F$ to non-float position $P_{NF}$.

Alternatively, if after entering work tool float mode $M_F$ controller 96 determines, at step 708, that no float request R has been received (via input 146), the method proceeds to step 714, in which the float is inactive and blade 30 is maintained in non-float position $P_{NF}$. When blade 30 is in non-float position $P_{NF}$ (either because no float request R was ever received after entering work tool float mode $M_F$, or because a float request R was initially received but then withdrawn), there is generally no need to limit machine speed V for any reason relating to float. In step 716, the method therefore removes float active machine speed limit $L_{FAMS}$ so as to not limit machine speed V to float active machine speed limit $L_{FAMS}$.

Figure 8:
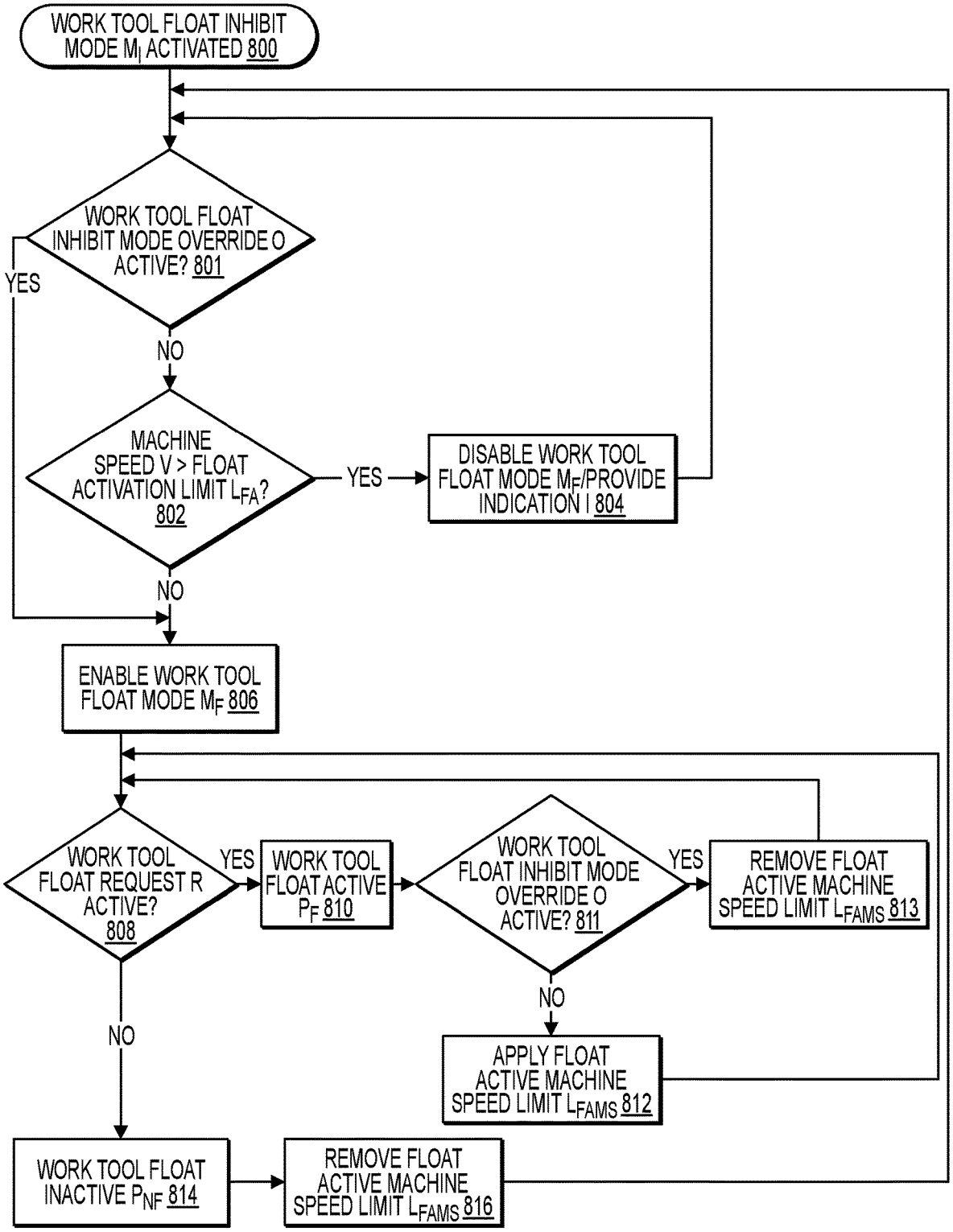
FIG. 8 shows another work tool float management method according to the present disclosure.

FIG. 8 shows a method that is similar to that shown in FIG. 7, but incorporates a work tool float inhibit override O at input 148. Work tool float inhibit override O) permits the operator of motor grader 10 to allow blade 30 to be put into float position $P_F$ despite work tool float inhibit mode $M_I$ being active and despite machine speed V being greater than float activation limit $L_{FA}$.

If the last two digits of the step numbers in FIGS. 7 and 8 are the same (e.g., 704 and 804), the steps in FIG. 8 operate in the same manner as that described in the context of FIG. 7.

After work tool float inhibit mode $M_I$ is activated in step 800, controller 96 determines whether it receives work tool float inhibit override O at input 148. If work tool float inhibit override O at input 148 has not been received, the method in FIG. 8 proceeds to step 802, wherein controller 96 compares machine speed V to float activation limit $L_{FA}$, as in the context of the method of FIG. 7. If, however, work tool float inhibit override ( ) has been received, the method instead proceeds to step 806 and controller 96 enters work tool float mode $M_F$, irrespective of the output of any comparison of machine speed V to float activation limit $L_{FA}$. In work tool float mode $M_F$, blade 30 is movable to float position $P_F$, as discussed above.

In the case where controller 96 is in work tool float mode $M_F$ and a float request R has been received (i.e., in step 810), the method of FIG. 8 also differs from that of FIG. 7 in that controller 96 then again considers, in step 811, whether work tool float inhibit override O is active or has been received by controller 96. If work tool float inhibit override O) has not been received, in step 812 controller 96 operates in the same manner as step 712 in the context of FIG. 7, namely by applying float active machine speed limit $L_{FAMS}$ (via output 152) so as to limit machine speed V to float active machine speed limit $L_{FAMS}$. But if work tool float inhibit override O has been received, in step 813 controller 96 removes float active machine speed limit $L_{FAMS}$ (via output 152) so as to not limit machine speed V to float active machine speed limit $L_{FAMS}$. No matter whether float active machine speed limit $L_{FAMS}$ is applied or removed by controller 96, however, controller 96 continues to evaluate, at step 808, whether float request R continues to be received, as discussed above in the context of step 708.

INDUSTRIAL APPLICABILITY

In general, the mobile construction equipment, methods, and controllers of the present application are applicable for limiting the ability of a surface-engaging work tool to be put into a float position and/or limiting a machine speed of a mobile construction equipment to which the work tool is attached when the work tool is in the float position. By limiting the mobile construction equipment in this manner, the present application describes techniques for safer operation of mobile construction equipment when floating a surface-engaging work tool, namely by not allowing the work tool to be moved into the float position when the mobile construction equipment is operating at a higher machine speed. Furthermore, through the work tool float inhibit mode itself, the present application describes techniques for disallowing the ability to float the work tool in specific situations, which can be helpful if the operator of the mobile construction equipment to which the work tool is attached is inexperienced. The present application also describes the ability to manually override the work tool float inhibit mode so as to allow the work tool to float irrespective of the machine speed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The present disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A mobile construction equipment for operation on a surface, the mobile construction equipment comprising:

a work tool that is movable between at least one float position, in which the work tool floats with respect to the surface, and at least one non-float position, in which the work tool does not float with respect to the surface;

a machine speed sensor configured to provide a machine speed of the mobile construction equipment; and a controller having a work tool float mode, in which the work tool is movable to the at least one float position, the controller being configured, in a work tool float inhibit mode, in which the work tool is not movable to the at least one float position, to receive the machine speed, and, if the machine speed exceeds a float activation limit, at least one of:

disable the work tool float mode so as to prevent the work tool from moving to the at least one float position, or provide an indication to an operator of the mobile construction equipment that the machine speed exceeds the float activation limit, wherein, if the machine speed does not exceed the float activation limit, the controller is configured to enable the work tool float mode so as to allow the work tool to move to the at least one float position, and wherein the controller is configured to:

determine whether the controller has received a float request for the work tool to be moved to the at least one float position, and if the float request has not been received, keep the work tool in the at least one non-float position.

2. The mobile construction equipment of claim 1, wherein the controller is configured to:

if the float request has been received, move the work tool to the at least one float position.

3. The mobile construction equipment of claim 2, wherein the controller is configured to apply a float active machine speed limit to the mobile construction equipment so as to limit the machine speed to the float active machine speed limit while the work tool is in the at least one float position.

4. The mobile construction equipment of claim 3, wherein the controller is configured to:

determine whether the controller no longer receives the float request, and if the controller no longer receives the float request, move the work tool from the at least one float position to the at least one non-float position.

5. The mobile construction equipment of claim 4, wherein the controller is configured to remove the float active machine speed limit from the mobile construction equipment.

6. The mobile construction equipment of claim 1, wherein the controller is configured to remove a float active machine speed limit from the mobile construction equipment so as to not limit the machine speed to the float active machine speed limit while the work tool is in the at least one non-float position.

7. The mobile construction equipment of claim 1, wherein the controller has a work tool float inhibit override in which the controller is configured to override the work tool float inhibit mode and enter the work tool float mode so as to allow the work tool to move to the at least one float position.

8. The mobile construction equipment of claim 7, wherein the controller is configured to:

determine whether the work tool float inhibit override is active.

9. The mobile construction equipment of claim 8, wherein the controller is configured to:

if the work tool float inhibit override is active, remove a float active machine speed limit from the mobile construction equipment so as to not limit the machine speed to the float active machine speed limit, and if the work tool float inhibit override is not active, apply the float active machine speed limit to the mobile construction equipment so as to limit the machine speed to the float active machine speed limit.

10. The mobile construction equipment of claim 9, wherein the controller is configured to:

determine whether the controller no longer receives the float request, and if the controller no longer receives the float request, move the work tool from the at least one float position to the at least one non-float position.

11. The mobile construction equipment of claim 10, wherein the controller is configured to remove the float active machine speed limit from the mobile construction equipment so as to not limit the machine speed to the float active machine speed limit while the work tool is in the at least one non-float position.

12. A method for transitioning a work tool of a mobile construction equipment between at least one float position, in which the work tool floats with respect to a surface on which the mobile construction equipment is operating, and at least one non-float position, in which the work tool does not float with respect to the surface, the mobile construction equipment having a controller, the method comprising:

in a work tool float inhibit mode of the controller, in which the work tool is not movable to the at least one float position, receiving, by the controller, a machine speed of the mobile construction equipment;

under a condition where the machine speed does not exceed a float activation limit, enabling, by the controller, a work tool float mode, in which the work tool is movable to the at least one float position; or under a condition where the machine speed exceeds the float activation limit, at least one of:

disabling, by the controller, the work tool float mode so as to prevent the work tool from moving to the at least one float position, or providing an indication to an operator of the mobile construction equipment that the machine speed exceeds the float activation limit;

under a condition where the machine speed does not exceed the float activation limit:

determining, by the controller, whether the controller has received a float request for the work tool to be moved to the at least one float position, and in a case where the float request has been received, moving the work tool to the at least one float position;

applying a float active machine speed limit to the mobile construction equipment so as to limit the machine speed to the float active machine speed limit while the work tool is in the at least one float position;

determining, by the controller, whether the controller no longer receives the float request; and under a condition where the controller no longer receives the float request, moving the work tool from the at least one float position to the at least one non-float position.

13. The method of claim 12, further comprising:

removing from the mobile construction equipment, by the controller, the float active machine speed limit so as to not limit the machine speed to the float active machine speed limit while the work tool is in the at least one non-float position.

14. The method of claim 12, further comprising:

overriding, by the controller, the work tool float inhibit mode; and entering, by the controller, the work tool float mode so as to allow the work tool to move to the at least one float position.

15. A controller for a mobile construction equipment having a work tool movable between at least one float position, in which the work tool floats with respect to the surface, and at least one non-float position, in which the work tool does not float with respect to the surface, the controller being configured to:

in a work tool float inhibit mode of the controller, in which the work tool is not movable to the at least one float position, receive a machine speed of the mobile construction equipment;

if the machine speed does not exceed a float activation limit, enable a work tool float mode, in which the work tool is movable to the at least one float position; or if the machine speed exceeds the float activation limit, at least one of:

disable the work tool float mode so as to prevent the work tool from moving to the at least one float position, or provide an indication to an operator of the mobile construction equipment that the machine speed exceeds the float activation limit;

if the machine speed does not exceed the float activation limit, enable the work tool float mode so as to allow the work tool to move to the at least one float position;

determine whether a float request for the work tool to be moved to the at least one float position has been received; and if the float request has not been received, keep the work tool in the at least one non-float position.

* * * * *